US006679656B1

(12) United States Patent
Manthei

(10) Patent No.: US 6,679,656 B1
(45) Date of Patent: Jan. 20, 2004

(54) CONNECTION FOR GEOGRID TO CONCRETE BLOCK EARTH RETAINING WALLS

(75) Inventor: Benjamin R. Manthei, Petoskey, MI (US)

(73) Assignee: Redi-Rock International, LLC, Charlevoix, MI (US)

( * ) Notice: Subject to any disclaimer, the term of this patent is extended or adjusted under 35 U.S.C. 154(b) by 0 days.

(21) Appl. No.: 10/318,915

(22) Filed: Dec. 13, 2002

(51) Int. Cl.[7] ..... E02D 17/00; E02D 29/00; E04C 1/00

(52) U.S. Cl. ..... 405/284; 405/262; 405/286; 52/600; 52/605; 403/347

(58) Field of Search ..... 405/284, 286, 405/285, 262, 287; 52/600, 603, 605; 403/206, 347, 364, 381

(56) References Cited

U.S. PATENT DOCUMENTS

| | | | | | |
|---|---|---|---|---|---|
| 4,616,959 | A | * | 10/1986 | Hilfiker | 405/286 |
| 4,824,293 | A | * | 4/1989 | Brown et al. | 405/284 |
| 5,028,172 | A | * | 7/1991 | Wilson et al. | 405/286 |
| 5,066,169 | A | | 11/1991 | Gavin et al. | 405/284 |
| 5,257,880 | A | * | 11/1993 | Janopaul, Jr. | 405/284 |
| 5,419,092 | A | * | 5/1995 | Jaecklin | 52/562 |
| 5,531,547 | A | * | 7/1996 | Shimada | 405/262 |
| 5,564,865 | A | * | 10/1996 | Jansson | 405/286 |
| 5,975,809 | A | | 11/1999 | Taylor et al. | 405/262 |
| 5,975,810 | A | * | 11/1999 | Taylor et al. | 405/262 |
| 6,019,550 | A | | 2/2000 | Wrigley et al. | 405/262 |
| 6,193,445 | B1 | * | 2/2001 | Scales | 405/284 |
| 6,224,295 | B1 | * | 5/2001 | Price et al. | 405/262 |
| 6,318,934 | B1 | | 11/2001 | Borgersen et al. | 405/262 |
| 6,322,291 | B1 | | 11/2001 | Rainey | 405/262 |
| 6,338,597 | B1 | | 1/2002 | Rainey | 405/262 |
| 6,416,257 | B1 | | 7/2002 | Rainey | 405/262 |
| 6,443,662 | B1 | | 9/2002 | Scales et al. | 405/262 |
| 6,468,004 | B1 | * | 10/2002 | Price | 405/262 |
| 6,490,837 | B1 | * | 12/2002 | Dueck et al. | 52/603 |
| 6,536,994 | B2 | * | 3/2003 | Race | 405/262 |

FOREIGN PATENT DOCUMENTS

| | | | |
|---|---|---|---|
| GB | 2331317 | * | 5/1999 |
| WO | 0022241 | * | 4/2000 |

* cited by examiner

*Primary Examiner*—Jong-Suk (James) Lee
(74) *Attorney, Agent, or Firm*—MacMillan, Sobanski & Todd, LLC

(57) ABSTRACT

A connection for securing a geogrid fabric to between two tiers of concrete blocks which are stacked to form an earth retaining wall. A groove is formed in the top of each block in the lower tier to extend across the width of each block substantially parallel to the face of the block. The fabric is positioned to extend from the rear of the block over the groove and a first rod is positioned in the groove over the fabric. The fabric is folded to wrap around the first rod to extend past the groove towards the rear of the block and a second rod is positioned in the groove over the fabric to the rear of the first rod. When an upper tier of blocks is stacked on the lower tier, the rods and fabric are locked into the groove in the lower blocks.

8 Claims, 4 Drawing Sheets

CONNECTION FOR GEOGRID TO CONCRETE BLOCK EARTH RETAINING WALLS

CROSS-REFERENCE TO RELATED APPLICATIONS

Not Applicable.

STATEMENT REGARDING FEDERALLY SPONSORED RESEARCH OR DEVELOPMENT

Not Applicable.

TECHNICAL FIELD

The invention relates to earth retaining walls constructed from precast concrete blocks, and more particularly to a connection for securing a geogrid fabric to an earth retaining wall constructed from stacked concrete blocks.

BACKGROUND OF THE INVENTION

Earth retaining walls are frequently constructed from stacked precast concrete blocks. After the blocks are stacked on a suitable foundation, the earth side of the wall is filled with backfill. The maximum height of the retaining is limited by a number of factors, including the size and weight of the blocks, the foundation for the wall, the type of backfill and surrounding earth, and drainage. It is well known that a higher retaining wall can be constructed if the wall is secured to the adjacent earth with a geogrid system.

Various types of systems have been used in the past for stabilizing concrete block earth retaining walls. In one type of system, ground anchors are embedded in the earth behind the retaining wall and are connected through cables or rods to the wall to prevent the wall from moving. In another type of geogrid system, a perforated geogrid fabric is buried in the earth behind the wall. After one or more tiers of blocks are stacked to form a portion of the wall, backfill is added behind the wall to substantially the level of the top of the stack. The fabric is laid over the backfill and over the top of the adjacent blocks. The next tier of blocks are then stacked on the wall on top of the fabric. Different types of fabric have been used in geogrid systems of this type, including metal fabrics and fabrics formed from a tough, stable synthetic resinous material. The fabric is formed with sufficient openings or perforations to allow water to freely pass through the fabric, and to help the fabric to grip the adjacent soil.

U.S. Pat. No. 6,416,257 shows a geogrid system in which a groove is formed across the top of each block to extend parallel to the face of the block. The bottoms of the blocks forming an adjacent upper tier include a projection which extends part way into the groove. A geogrid fabric is laid over the top of the blocks in a tier and an elongated flat member is inserted into the groove, forcing the fabric into the groove. When a block is positioned in an adjacent upper tier, the bottom projection pushes the elongated member in the groove to secure the geogrid fabric to the block. With this system, it may be possible for a strong force to pull the fabric from between the tiers of blocks.

U.S. Pat. No. 6,019,550 teaches a method for securing a perforated plastic fabric to concrete block earth retaining wall. The blocks are formed with vertical passages which are aligned when the blocks are stacked. Pins are inserted in the passages to prevent the blocks from shifting relative to each other in a horizontal plane. A groove is formed in the top of each block to extend parallel to the face of the block. After a tier of blocks is stacked and backfill is added behind the wall, a geogrid fabric is placed to extend over the top of the blocks and the backfill. A special anchor member is then placed in the groove on top of the fabric. The anchor member includes longitudinally spaced projections which extend through the perforations in the fabric. When the next tier of blocks is stacked on the wall, the anchor member is confined in the groove and secures the fabric to the wall. The anchor member is designed for use with blocks having a top groove sized to receive the anchor member and the fabric and having projections which have the same longitudinal spacing as the spacing between perforations in the fabric. Also, it is necessary to align the fabric with the wall blocks so that a row of perforations are positioned to receive the anchor member when the anchor member is inserted into the groove in the top of the blocks.

BRIEF SUMMARY OF THE INVENTION

The invention is directed to a connection for securing a geogrid fabric to a concrete block earth retaining wall for stabilizing the wall. According to the invention, a groove is formed in the top of each block to extend across the width of the block substantially parallel to the face of the block. The groove in each block will connect with the grooves in the tops of any adjacent blocks in a tier. After blocks in a tier are positioned for constructing a wall, the area behind the wall is backfilled and the geogrid fabric is laid over the backfill and the top of the blocks so that an end of the fabric extends past the groove formed along the top of the tier. A first steel rod is then positioned on top of the fabric and pressed into the groove. If the grooves are longer than first rods, two or more rods are positioned end to end to extend the length of the groove. The end of the fabric is folded over the rod to extend towards the back of the wall. One or more second rods are then placed in the groove above the fabric to the rear of the first rods. The next tier of blocks is then positioned on top of the previously constructed tier of blocks and the geogrid fabric. This tier of blocks closes the groove on the top of the adjacent lower tier and confines the rods to the groove. If a force attempts to move the regaining wall, pulling on the geogrid fabric, the first and second rods become wedged in the groove to prevent slippage of the fabric. Accordingly, a simple construction is provided for securing a geogrid fabric to stacked blocks which form a retaining wall.

Various objects and advantages of the invention will become apparent from the following detailed description of the invention and the accompanying drawings.

DETAILED DESCRIPTION OF THE INVENTION

Figure 1:
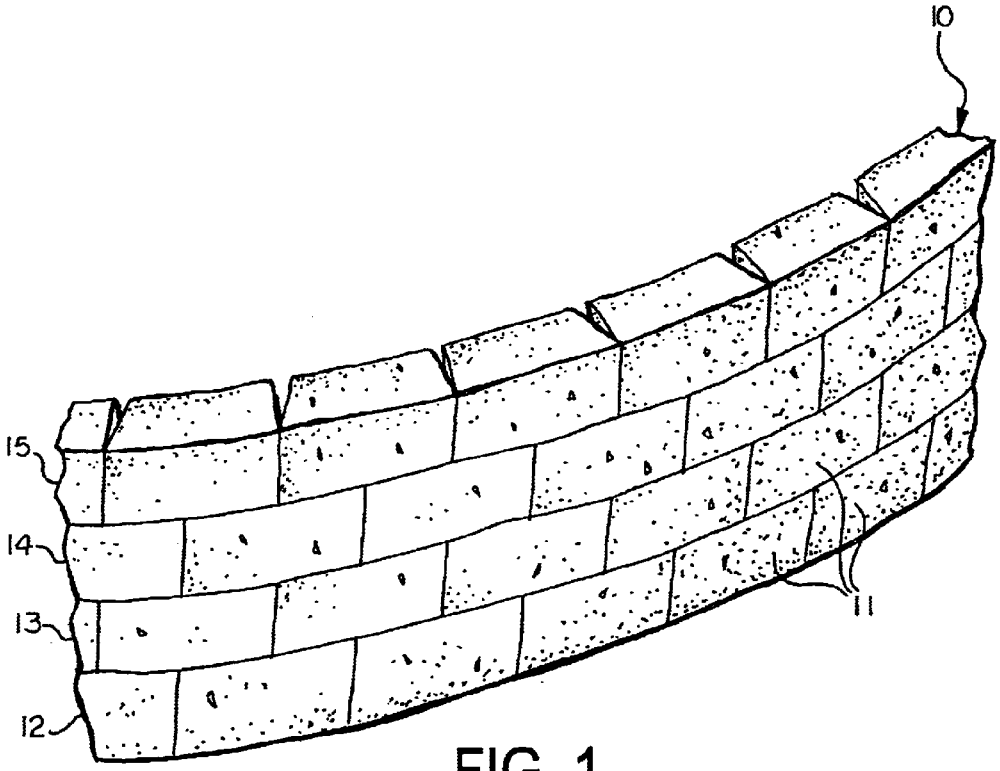
FIG. 1 is a perspective view of an exemplary four tier retaining wall formed from stacked concrete blocks.

FIG. 1 is an perspective view of an exemplary earth retaining wall 10 constructed from a plurality of precast concrete blocks 11 which are stacked in tiers to a desired height. The exemplary wall 10 has four tiers 12–15. The wall 10 may be constructed with any desired shape, for example, it may be curved, as shown, or straight or shaped to follow a desired terrain. The blocks 11 may be formed to have any desired size, provided that they are sufficiently large for constructing a stable retaining wall. An exemplary block is about 46.5 inches (1.18 m) wide by 18 inches (0.46 m) high by 30 to 42 inches (0.76 to 1.07 m) deep.

Depending on various factors including, but not limited to, the soil type, drainage, the size and weight of the blocks 11, and the height and design of the retaining wall 10, it may be necessary to stabilize the wall with a geogrid system which forms a stabilizing connection between the retaining wall 10 and the ground behind the retaining wall. A typical geogrid system consists of a perforated fabric which is embedded in the soil behind the wall and is secured to the wall. Various geogrid fabrics for use in stabilizing are commercially available. An exemplary geogrid fabric which may be used to stabilize the retaining wall 10 consists of a planar sheet of synthetic material which is formed into a network of integrally connected polymeric tensile elements. Apertures or perforations extend through the fabric between the tensile elements to pass water. The geogrid fabric either is secured to the retaining wall blocks 11 or is secured between tiers of blocks forming the wall 10. In an exemplary retaining wall, a separate geogrid connection is made at every second or third tier of the wall. The location and design of the geogrid system will be determined by the needed stability of the wall. During construction of the retaining wall, the fabric is secured to the wall and is embedded in the backfill behind the wall. Spaced apertures formed in the fabric interlock with the fill material behind the retaining wall 10 to securely anchor the fabric to the earth.

Figure 2:
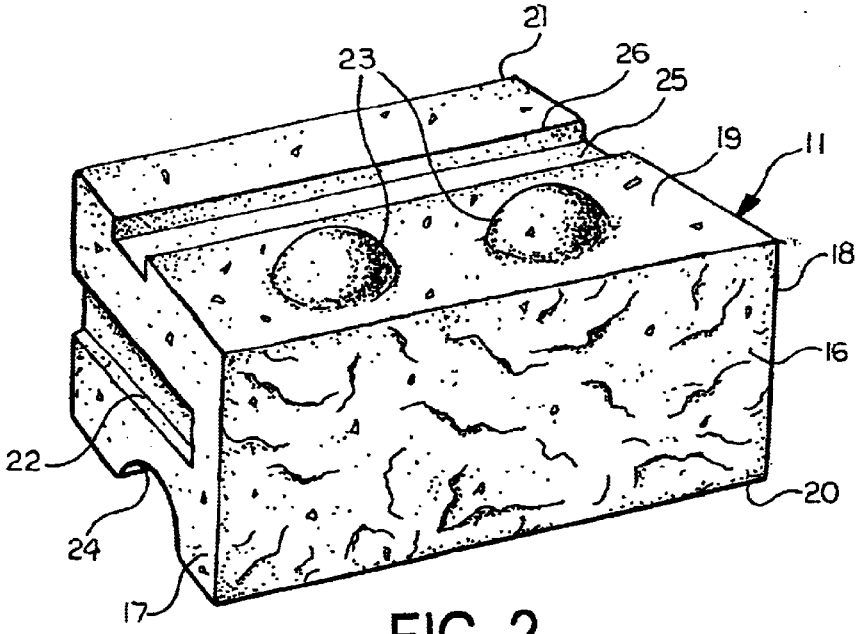
FIG. 2 is a perspective view of an exemplary block for use in the retaining wall of FIG. 1.

An exemplary precast concrete retaining wall block 11 is shown in FIG. 2. The block 11 has a face 16 which forms the exposed side of the retaining wall 10. Preferably, the face 16 is textured and optionally colored to simulate natural stone. The block 11 has left and right sides 17 and 18, a top 19, a bottom 20 and a rear 21. In plan view, the rear 20 may be shorter than the face 16 so that the block 11 is generally trapezoidal. This permits the faces 16 of adjacent blocks in a wall tier to be angled relative to each other to form a curving wall. An optional groove 22 may be formed in each side 17 and 18 to extend from the rear 21 to just short of the face 16 to permit lifting and moving the block 11 with a forklift.

Preferably, a known arrangement may be provided for preventing stacked blocks 11 in a tier from shifting relative to the blocks in an adjacent lower tier. For the exemplary block 11, two knobs 23 project from the top 19 equidistant from the face 16. A groove 24 is formed in the bottom of the block 11 so that when the block 11 is stacked on top of another block 11, the bottom groove 24 on the upper block receives the top knobs 23 on any adjacent lower blocks. It should be appreciated that the bottom groove 24 may be omitted from the blocks which form the lowermost tier of a retaining wall and that the top knobs 23 may be omitted from the blocks which form the uppermost tier of the retaining wall. If the retaining wall is to have a vertical face, the knobs 23 and the groove 24 will have the same spacing from the face 16. If the face of an upper tier is to be offset behind the face of an adjacent lower tier, the knobs 23 on the lower tier will be spaced further from the face of the blocks in the lower tier than the spacing of the groove 24 from the face of the blocks in the upper tier.

According to the invention, a groove 25 is formed in the block top 19 to extend substantially parallel to the block face 16 to the rear of the knobs 23. Preferably, a top rear corner 26 of the groove 25 is slightly rounded or relieved for reasons which are described below.

Figure 3:
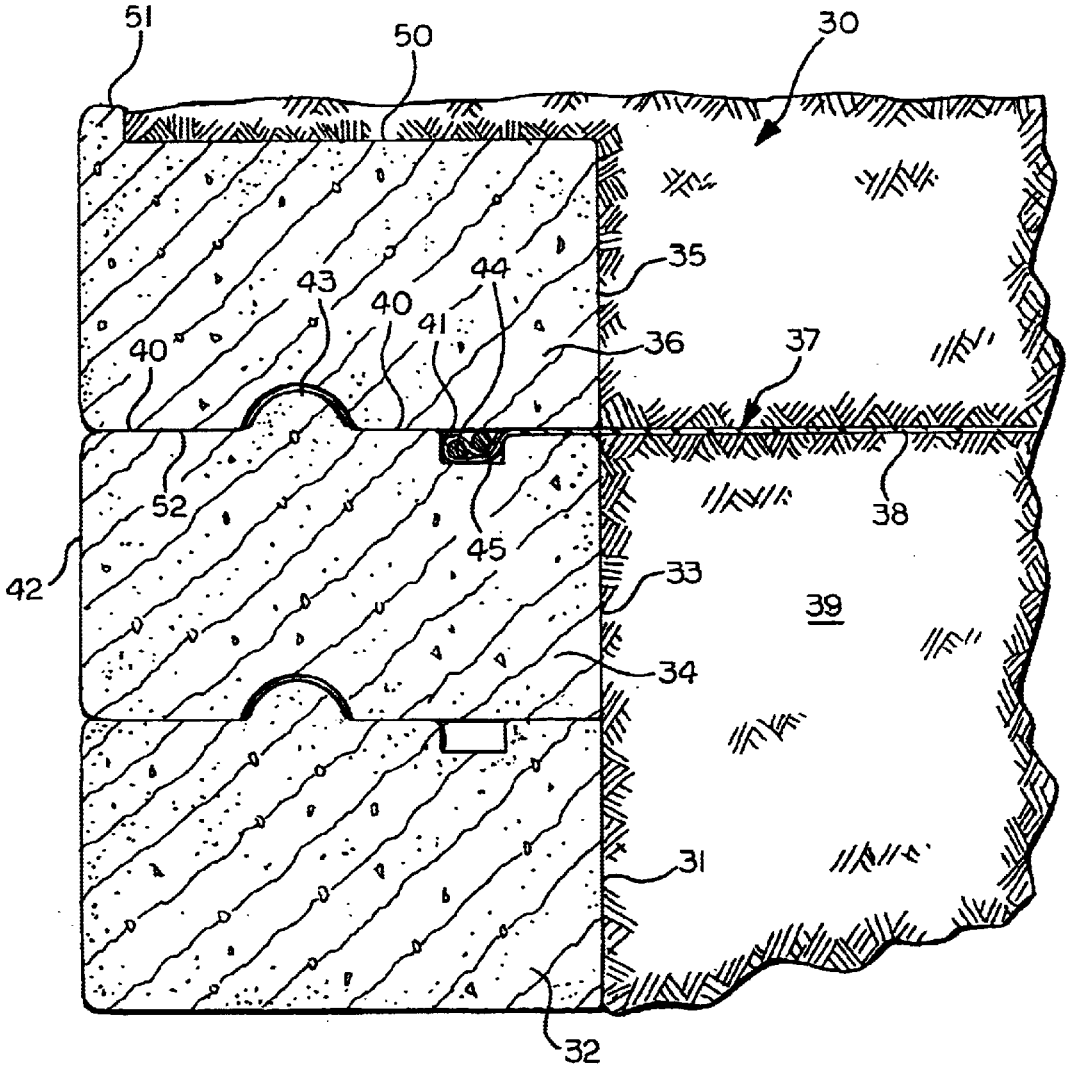
FIG. 3 is a fragmentary right end view through an exemplary three tier retaining wall with a geogrid system according to the invention connected between the second and third tiers.

FIG. 3 shows an end view of a three tier retaining wall 30 having a lower tier 31 of blocks 32, a second tier 33 of blocks 34 and an upper tier 35 of blocks 36. The retaining wall 30 is stabilized with a geogrid system 37 which includes a conventional geogrid fabric 38 secured to the wall 30 between the tiers 33 and 35. The fabric 38 is embedded in the soil 39 to the rear of the wall 30. Preferably, the fabric 38 has perforations or apertures which securely engage the soil 39 to prevent the fabric 38 from being pulled relative to the soil 39.

The geogrid fabric 39 extends over a top 40 of the block 34 and is secured in a groove 41 in the top which extends across the width of the block substantially parallel to a front face 42 of the block 34. If the block 34 is provided with top knobs 43 for aligning the tiers 33 and 35, as shown, the knobs 43 are positioned towards the face 42 from the groove 42.

Figure 4:
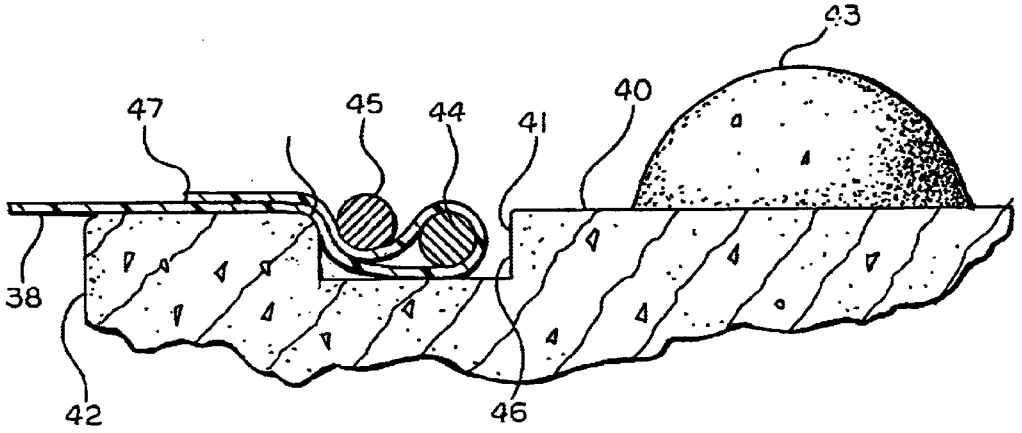
FIG. 4 is a fragmentary cross sectional view showing partial assembly of a connector according to the invention for securing a geogrid fabric to two stacked retaining wall blocks.
Figure 5:
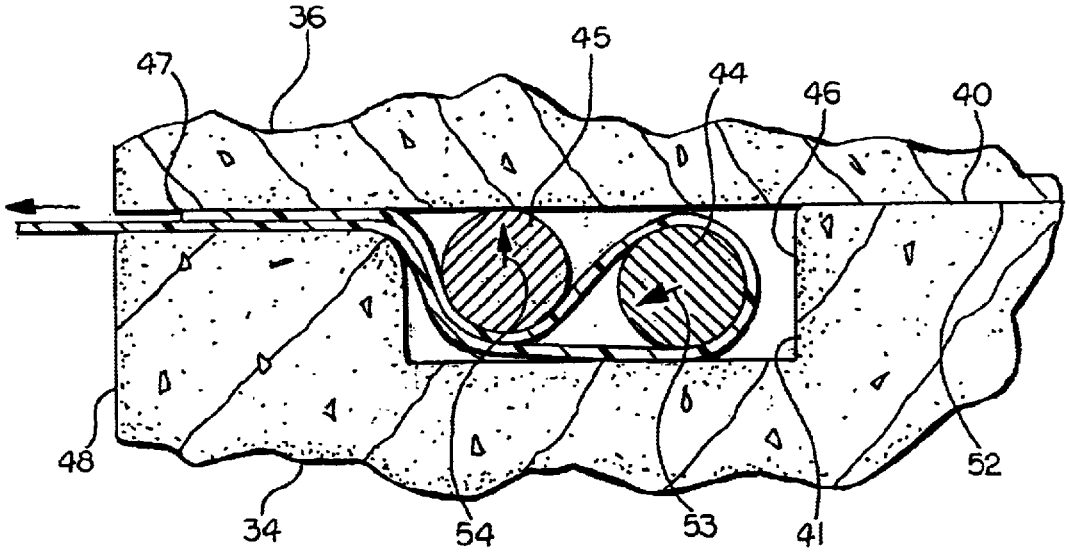
FIG. 5 is a fragmentary cross sectional view of the assembly of FIG. 4 with an upper block positioned on an adjacent lower block to complete the connector which secures the geogrid fabric to the wall.

As best shown in FIGS. 4 and 5, two rods 44 and 45 are used to form a connection which secures the fabric 48 to the groove 41. After the tier 33 is set when the wall 30 is being constructed, soil or other backfill 39 is placed behind the wall to extend substantially level with the top 40 of the block 34. The fabric 38 is then laid over the soil 39 and over at least a portion of the block top 40 to extend past the groove 41. A rod 44 is then placed over the fabric 38 and the groove 41. The rod 44 is pressed down into a forward end 46 of the groove 41. A free end 47 of the fabric 38 is folded back over the rod 44 towards a rear surface 48 of the block 34. The second rod 45 is then positioned in the groove 41 on top of the fabric 38 to the rear of the rod 44. Preferably, an upper rear edge 49 is slightly rounded or relieved to prevent the edge 49 from cutting the fabric 38 when tension is placed on the fabric 38.

Preferably, the rods 44 and 45 are conventional rebar which is used to reinforce concrete structures. However, other types of rods also may be used. If a rod 44 or 45 is not sufficiently long to extend across the tier 33, two or more rods may be positioned end to end in the grooves 41 which extend across the tier. If the wall 30 is curved, either the rods 44 and 45 may be bent to follow the curve, or rods 44 and 45 may be cut to the length of each block groove 41 where the wall curves and longer rods may be used where the wall is straight.

After the fabric 38 and the rods 44 and 45 are positioned in the grooves 41 for the blocks forming the tier 33, the blocks 36 are positioned on top of the tier 33 to construct the upper tier 35. If desired, the blocks 36 may have an upper surface 50 which is recessed below an upper front edge of the blocks 36 so that the soil 39 can extend over the top of the blocks 36. The blocks 36 have a lower surface 52 which rests on the blocks 34. The lower surface 52 covers the groove 41. To the rear of the groove 41, the fabric 38 and the fabric end 47 are pinched between the blocks 34 and 36. As a consequence, any attempt to pull the fabric 38 from between the blocks will attempt to cause the fabric end 47 to move in an opposite direction. Any attempt to pull the fabric 38 from between the blocks 34 and 36 also will urge the rod 44 to move in the direction of the arrow 53 and the rod 45 to move in the direction of the arrow 54 (FIG. 5). This will cause the rods 44 and 45 to wedge together between the blocks 34 and 36, tightly locking the fabric 38 to the retaining wall 30.

It will be appreciated that various modifications and changes may be made to the above described preferred embodiment of without departing from the scope of the following claims. An exemplary precast concrete retaining wall block 11 with top knobs 23 and bottom grooves 24 has been shown and described. It will be apparent that the invention may be used with other types of retaining wall blocks. It also will be apparent that the terms "soil", "earth" and "backfill" may encompass various types of fill material including dirt, sand, and gravel and a combination thereof.

What is claimed is:

1. An earth retaining wall comprising at least one first block having a front, a top surface, two sides and a rear, and at least one second block having a bottom positioned over at least a portion of said top surface of said first block, said first block having a longitudinal groove in said top surface extending between said sides of said first block, said bottom of said second block closing at least a portion of said groove, said groove having a front side and a rear side, a first rod positioned in said groove towards said front side of said groove, a second rod positioned in said groove towards said rear side of said groove, and a geogrid fabric embedded in earth behind said retaining wall and extending between said first and second blocks generally in a direction towards said front and into said groove, below said first and second rods, around said first rod and then in a direction generally towards said rear below said second rod, out of said groove.

2. An earth retaining wall, as set forth in claim 1, and wherein said retaining wall includes a plurality of first blocks arranged in a lower tier, and a plurality of second blocks arranged in an upper tier stacked on top of said first tier.

3. An earth retaining wall, as set forth in claim 2, and wherein the groove in the top of each first block connects with the groove in any adjacent blocks in said lower tier to form a channel extending along said first tier, and wherein said first and second rods extend along said channel in a plurality of said first blocks.

4. An earth retaining wall, as set forth in claim 3, and wherein said first rod comprises at least two first rods positioned end to end in said channel, and said second rod comprises at least two second rods positioned end to end in said channel.

5. An earth retaining wall, as set forth in claim 1, and wherein said rear of said groove and said first block top join at an edge which is rounded.

6. An earth retaining wall, as set forth in claim 1, and further including a projection extending from said first block top at a location between said groove and said front, and wherein said second block includes a recess in said bottom which receives said projection.

7. A method for securing a geogrid fabric to a retaining wall formed from at least two stacked concrete blocks, a lower one of said blocks having a front, a top surface, two sides, a rear and a groove in said top extending between said two sides in a direction generally parallel to said front, said groove having a front side and a rear side, and an upper one of said blocks having a bottom, said method comprising the steps of:

a) placing the geogrid fabric to extend from the rear of said lower block to extend over at least a portion of said top and over said groove;

b) placing a first rod in said groove above said geogrid fabric and towards said front side of said groove;

c) folding an end portion of said geogrid fabric around said first rod to extend past said groove towards said rear of said first block;

d) placing a second rod in said groove above said folded end portion of said geogrid fabric; and e) placing said upper block on top of at least a portion of said lower block to cover at least a portion of said groove to confine said first and second rods in said groove.

8. A method for securing a geogrid fabric to a retaining wall formed from a plurality of first concrete blocks arranged in a lower tier of said retaining wall, said first blocks each having a front, a top surface, two sides, a rear and a groove in said top extending between said two sides in a direction generally parallel to said front, said groove in each first block connecting with the groove in any adjacent blocks to form a channel having a front side and a rear side and extending along said lower tier, and a plurality of second blocks each having a bottom, said method comprising the steps of:

a) placing the geogrid fabric to extend from the rear of said lower tier to over at least a portion of the top of at least a portion of said blocks in said lower tier and over said channel;

b) placing a first rod in said channel above said geogrid fabric and towards said front side of said channel;

c) folding an end portion of said geogrid fabric around said first rod to extend past said channel towards said rear of said first block;

d) placing a second rod in said channel above said folded end portion of said geogrid fabric; and e) placing said second blocks on top of said first blocks to cover at least a portion of said channel to confine said first and second rods in said channel.

* * * * *